United States Patent [19]

Bussard

[11] Patent Number: 4,753,496

[45] Date of Patent: Jun. 28, 1988

[54] CABINET WITH BUILT-IN FAN

[76] Inventor: Janice W. Bussard, 201 N. Fruit Port Rd., Spring Lake, Mich. 49456

[21] Appl. No.: 91,741

[22] Filed: Aug. 31, 1987

[51] Int. Cl.[4] ..... A47B 77/08; F25D 11/00

[52] U.S. Cl. ..... 312/236; 312/116

[58] Field of Search ..... 312/236, 116; 62/256, 62/257; 47/41

[56] References Cited

U.S. PATENT DOCUMENTS

| | | | |
|---|---|---|---|
| 2,275,772 | 3/1942 | Koch | 312/236 |
| 2,444,887 | 7/1948 | Wyeth | 312/236 |
| 2,863,302 | 12/1958 | Morris | 62/256 |
| 3,836,220 | 9/1974 | Ishammar | 312/236 |
| 3,895,215 | 7/1975 | Gordon | 312/236 |
| 4,014,598 | 3/1977 | Stalley et al. | 312/236 |
| 4,458,501 | 7/1984 | Kooy | 312/236 |

FOREIGN PATENT DOCUMENTS

| | | | |
|---|---|---|---|
| 456753 | 5/1949 | Canada | 312/236 |
| 0658170 | 10/1986 | Switzerland | 312/236 |

*Primary Examiner*—Victor N. Sakran

[57] ABSTRACT

An enclosed area, such as a cabinet, having a section for items and also a separate section containing an air circulating system contained within the cabinet.

4 Claims, 2 Drawing Sheets

Fig. 1
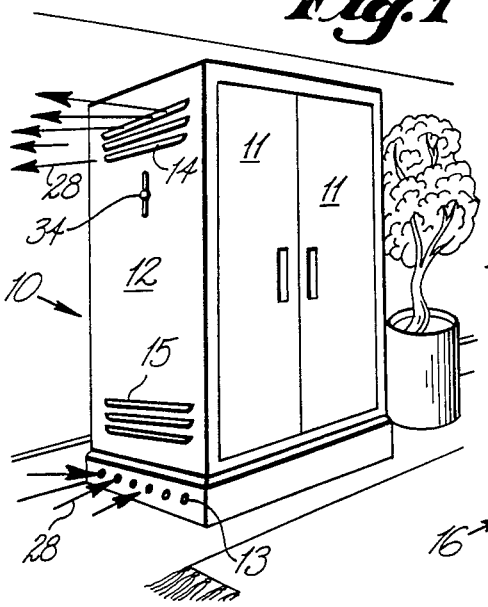
Fig. 2
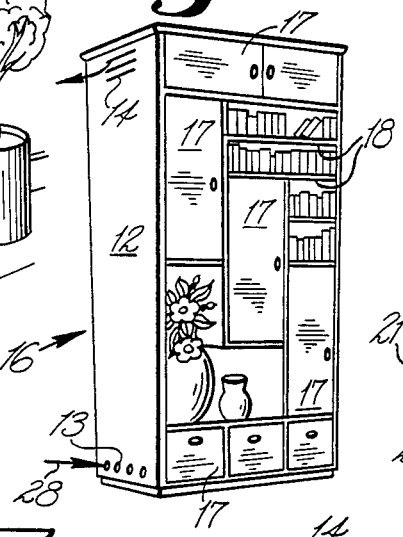
Fig. 3
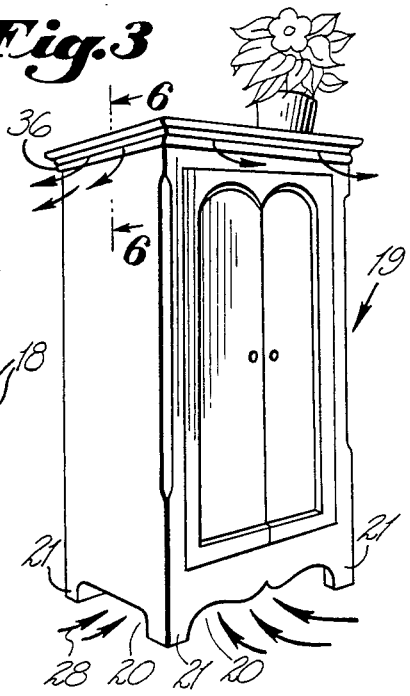
Fig. 4
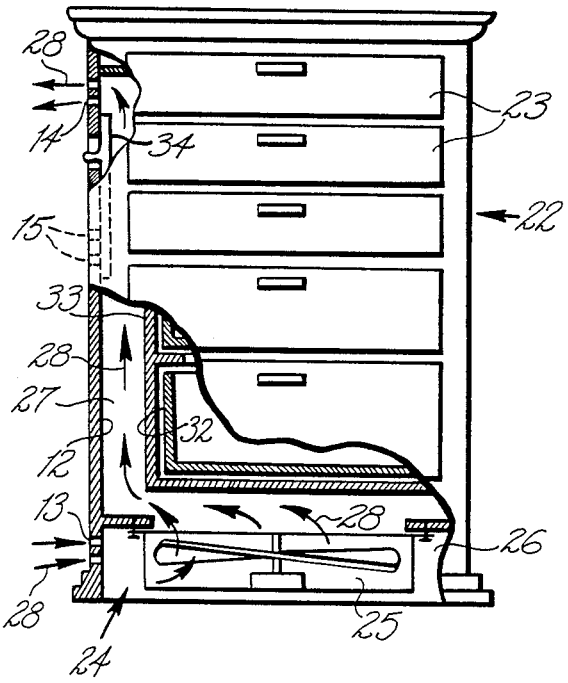
Fig. 5
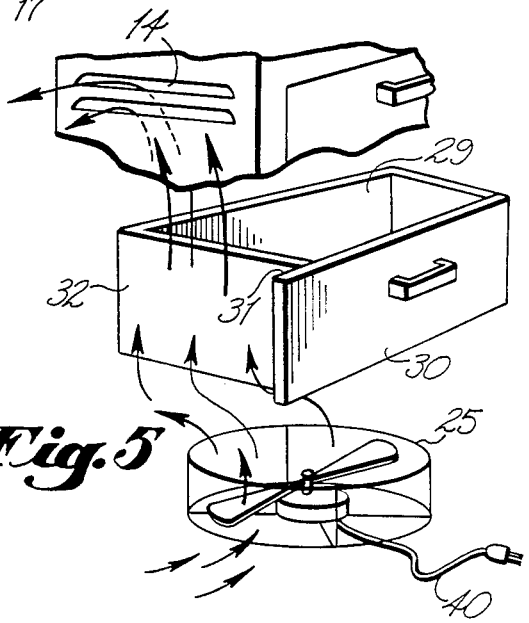
Fig. 6
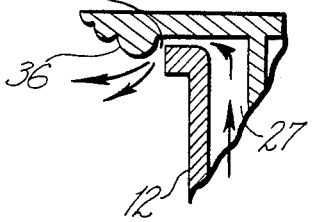
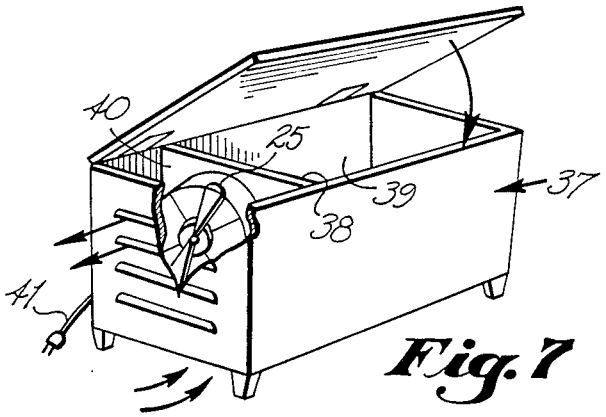
Fig. 7

Fig. 8
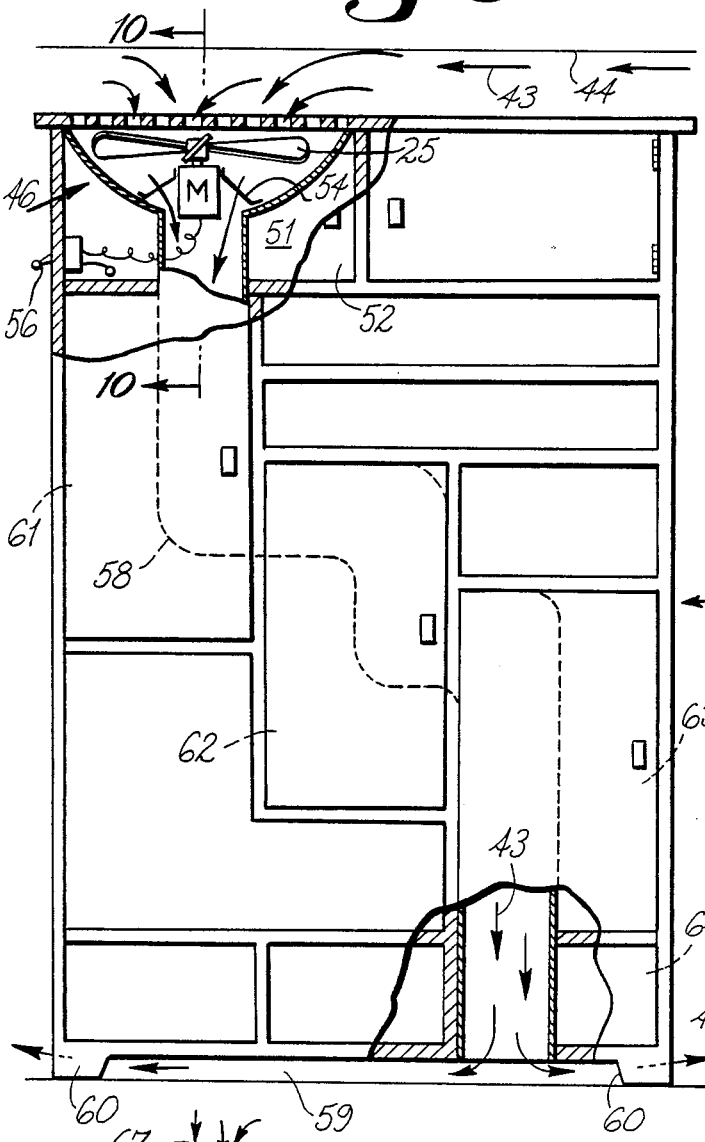
Fig. 10
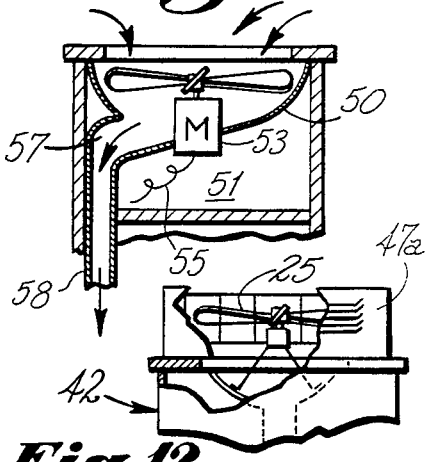
Fig. 12
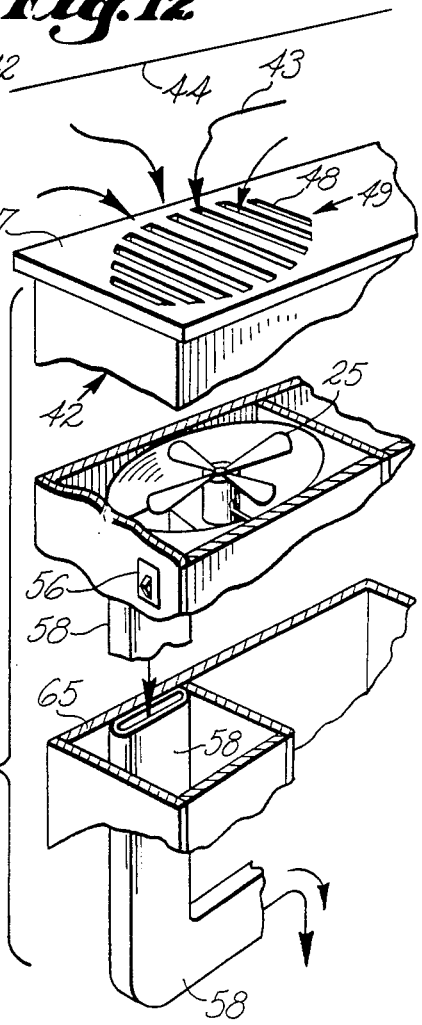
Fig. 9
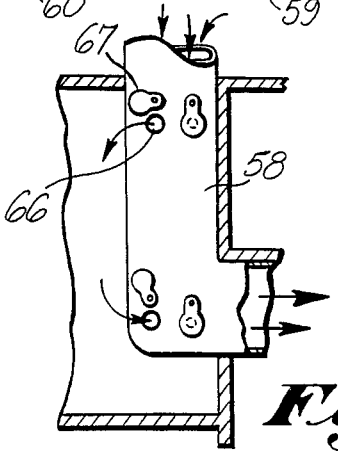
Fig. 11

CABINET WITH BUILT-IN FAN

BACKGROUND OF THE INVENTION

1. Field of the Invention

This invention relates generally to cabinetry furniture. More specifically, it relates to cabinets of the type that are used to furnish a home or an office for containing various items. Still more specifically it relates to individual air circulating fans for use in a furnished interior.

Prior Art

It is well known that in many attractively decorated home and office interiors provided with air circulating equipment, ceiling fans are popularly being used. They give an ornamental charm as well as use. However, they do not suit all decors, and some persons object to draft therefrom when below them. This situation is objectionable and is therefore in need of an improvement.

SUMMARY OF THE INVENTION

Accordingly it is a principal object of the present invention to provide furniture cabinetry placeable in a room or office for various specific conventional uses but which additionally contain a fan that will circulate air in a room or office space so as to replace the need for any ceiling fans.

Another object is to provide a cabinet or enclosure having a built-in fan, wherein the cabinet or enclosure may comprise either a bureau of drawers, a bookcase, a breakfront, an entertainment hi-fi center, a clothes wardrobe, any storage cabinet, kitchen soffit, or any office work station or storage area within a furnished office environment.

Still another object is to provide a cabinet having a built-in fan, wherein the cabinet appearance is not affected in any way by the fan hidden therewithin, and the air circulation from the fan does not blow a draft at persons but is being directed away so as to diffuse into the room.

Yet a further object is to provide a cabinet having a built-in fan, wherein the fan is located out of a way so as to not take away valuable cabinet storage space.

Another object is to provide an improved cabinet with built-in fan wherein the fan may be installed either at an upper end or lower end of the cabinet, being located either therewithin or externally therebelow or thereabove.

These and other objects will be readily evident upon a study of the following specification and the accompanying drawings.

BRIEF DESCRIPTION OF THE DRAWING FIGURES

FIG. 1 is a perspective view of one design of cabinet incorporating the invention.

FIG. 2 is a perspective view of another design thereof.

FIG. 3 is a view similar to FIG. 1, showing another model of the cabinet.

FIG. 4 is a front elevational view of a cabinet shown partly broken away to illustrate the air circulation system therewithin.

FIG. 5 is a fragmentary perspective view of structure shown in FIG. 4.

FIG. 6 is an enlarged cross-sectional view taken on line 6—6 of FIG. 3.

FIG. 7 is a perspective view of a low chest incorporating the invention.

FIG. 8 is a front elevational view of yet another modified design of the invention, shown partly broken away so to illustrate the interior construction.

FIG. 9 is a fragmentary perspective view thereof.

FIG. 10 is a cross-sectional view taken on line 10—10 of FIG. 8.

FIG. 11 is a fragmentary front view of an air duct passing through one of the cabinet compartments shown in FIG. 8.

FIG. 12 is a view similar to FIG. 11 and showing another modified design wherein the fan unit is mounted spaced above a top of the cabinet.

DETAILED DESCRIPTION OF PREFERRED EMBODIMENTS

Referring now to the drawings in greater detail, and more particularly to FIG. 1 thereof at this time, the reference numeral 10 represents a cabinet according to the present invention, wherein front doors 11 provide access to the interior thereof for storage of items. One wall 12 of the cabinet has a series of openings 13 near its lower end, a series of slots 14 near its upper end and another series of slots 15 intermediate therebetween, for air of a room to circulate through the cabinet in either direction, depending upon which direction a fan (not shown) rotates inside the cabinet, and which of the openings or slots are selectively in an opened position. Thus cooler air near a floor may cool off the warmer upper area of a room in summertime, or it may be reversed in wintertime.

Referring now to FIG. 2, the invention is shown incorporated into a modern wall unit 16 that may embody a hi-fi or home entertainment center, and which includes cabinet compartments 17, shelves 18 and the like. In the present invention it includes the fan air circulating system described in FIG. 1.

FIG. 3 illustrates another cabinet 19 incorporating the invention, and which is of colonial period design so to differ from the modern design shown in FIG. 1. In this design the air space 20 between the legs 21 replaces the air openings 13.

In FIGS. 4 and 5, the cabinet 22 comprises a bureau with drawers 23, and illustrates a typical fan air circulating system 24 such as is used in FIGS. 1, 2 and 3. A conventional, rotary air fan 25 is installed in an otherwise unused, out-of-the-way space 26 underneath the drawers. An air passage 27 between the air openings 13 and slots 14 extends through the fan so as to move air 28 through the system. The drawers accordingly comprise a drawer box 29 which at one end is shorter than the drawer front wall 30 so as to form the air passage behind the portion 31 of the drawer front wall and between the cabinet wall 12 and drawer end wall 32 or the drawer support 33. Meantime the drawers appear conventionally centered when viewing a front of the cabinet.

If the cabinet is made to include intermediate slots 15, then a manually slidable baffle 34 is included for selectively closing the slots 14 or 15. It is to be noted that these slots and the openings 13 need not necessarily be located on a side wall of the cabinet but may be made on the cabinet rear wall or on top of the unit so as to be hidden from view. Alternately as shown in FIGS. 3 and 6, the slots (or openings) may be hidden inside the crevices 35 of a decorative molding 36 or other ornamentation.

FIG. 7 illustrates the invention incorporated in a low cabinet 37, such as a linen chest or the like, instead of a tall cabinet. A partition 38 divides the chest into a compartment 39 for storing items, and a compartment 40 for the fan. An extension cord 41, attachable to a household electric socket, powers the fan.

In still another design, not shown, a flexible plastic tubing may line the air passage for confining the air flow through the cabinet 42.

Referring now to FIGS. 8 to 12, another design of the invention is shown wherein an upright cabinet 43 is generally similar to the cabinet 16 shown in FIG. 2, but which has the fan 25 located at the upper end of the cabinet so as to be especially adaptable to draw heated air 43 that has collected adjacent a ceiling 44 of a room and then move this hot air downwardly through the cabinet to a floor 45 so that the cold floor area can be heated up for greater comfort to persons during cold wintry weather, or reversed for a cooling effect in summertime. The fan is hidden within a top compartment 46 of the cabinet so as to not detract the cabinetry design and decor of a room.

In this form of the invention, the cabinet top panel 47 is above eye level of persons in the room, so that they do not see a set of slots 48 through the top panel, and which form a grill 49 through which the air is pulled inward. The fan is caged inside a funnel-shaped housing 50 rigidly mounted inside compartment 46 so as to leave a storage space 51 around the housing for storing of other items behind front door 52. The fan may be caged and rigidly mounted above the top panel 47, as shown in FIG. 12, so as not to restrict the force of the air inward and downward while being hidden from view behind a top horizontal panel or grill 47a on the front of the cabinet.

The fan is driven by an electric motor 53 supported by a bracket 54 on a bottom of the housing, and is connected by wiring 55 to a switch 56 conveniently mounted on a side of the cabinet for turning it "on" or "off". From there an extension cord (not shown) extends downward on a rear of the cabinet and has a plug on its end for connection to a household electric outlet socket.

An opening 57 in a lower end of the housing 50 communicates with a duct 58 extending down through a bottom wall of the cabinet so as to discharge the hot air into a space 59 underneath and then flows out between legs 60 so as to diffuse on the floor area of the room.

As shown in FIG. 8, the duct is zig-zag shaped so as to extend through the various compartments *61, 62, 63* and 64 that are adjacent to each other in order that the duct remains fully hidden inside the cabinet and is nowhere exposed to view. As shown in FIG. 9, the duct is made to be relatively thin and flat so as to rest against a rear wall 65 of the compartments and not take away space for storing of other items in the compartments.

FIG. 11 shows vent openings 66 may be provided along the duct so as to allow a portion of the air from the duct to circulate also through a compartment and thus prevent any mustiness created by stagnant air collected therein. Pivotable flaps 67 serve to open or close the vent openings.

FIG. 12 illustrates the design wherein the fan 25 and its surrounding cage are mounted above the cabinet top panel 47 and are hidden from view behind a raised wall 47a on top of the panel. The raised wall is slitted for air to circulate through it.

While various changes may be made in the detail construction, it is understood that such changes will be within the spirt and scope of the invention, as is defined by the appended claims.

What I claim as new, is:

1. A cabinet assembly, comprising, in combination, an upright cabinet containing a plurality of compartments located adjacent each other and arranged in a zig-zag fashion between a top and bottom of said cabinet, a door at a front of each said compartment for access thereinto, a rear wall on said cabinet closing a rear of said compartments, an air duct inside said cabinet extending through said top and bottom thereof, said duct being zig-zagged in shape so to extend through said compartments, said duct being flat and thin and resting against said rear wall, a storage space inside each said compartment between said door and said duct; an air fan at one end of said duct, an opposite end of said duct being left open, and a plurality of manually closable vent openings along said duct providing selective communication between an interior of said duct and each said compartment.

2. The combination as set forth in claim 1, wherein said fan is mounted in a storage space below a bottom wall of said cabinet.

3. The combination as set forth in claim 1 wherein said fan is at a top of said cabinet.

4. The combination as set forth in claim 3, wherein said fan is mounted on top a top wall of said cabinet and is hidden from view by a raised, slitted enclosure.

* * * * *